US009359583B2

(12) United States Patent
Corona, III et al.

(10) Patent No.: US 9,359,583 B2
(45) Date of Patent: Jun. 7, 2016

(54) FABRIC CARE COMPOSITIONS

(71) Applicant: The Procter & Gamble Company, Cincinnati, OH (US)

(72) Inventors: Alessandro Corona, III, Mason, OH (US); Traneil K. Clark, Cincinnati, OH (US); Jeffrey Scott Dupont, Cincinnati, OH (US); Nathan Lee Hall, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/447,978

(22) Filed: Jul. 31, 2014

(65) Prior Publication Data

US 2014/0364356 A1 Dec. 11, 2014

Related U.S. Application Data

(63) Continuation of application No. 13/659,943, filed on Oct. 25, 2012, now abandoned.

(60) Provisional application No. 61/552,793, filed on Oct. 28, 2011.

(51) Int. Cl.

| | |
|---|---|
| ***C11D 11/00*** | (2006.01) |
| ***C11D 3/00*** | (2006.01) |
| ***B01F 5/06*** | (2006.01) |
| ***B01F 5/10*** | (2006.01) |
| ***B01F 13/10*** | (2006.01) |
| ***C11D 1/62*** | (2006.01) |

(52) U.S. Cl.

CPC ..... *C11D 3/0015* (2013.01); *B01F 5/0654* (2013.01); *B01F 5/0688* (2013.01); *B01F 5/102* (2013.01); *B01F 13/1027* (2013.01); *C11D 1/62* (2013.01); *B01F 2215/0477* (2013.01)

(58) Field of Classification Search

CPC ..... C11D 3/0015; C11D 11/0094
USPC ..... 510/522, 527
See application file for complete search history.

(56) References Cited

U.S. PATENT DOCUMENTS

| | | | |
|---|---|---|---|
| 3,299,112 | A | 1/1967 | Bailey |
| 4,137,180 | A | 1/1979 | Naik et al. |
| 4,818,421 | A | 4/1989 | Boris et al. |

(Continued)

FOREIGN PATENT DOCUMENTS

| | | | |
|---|---|---|---|
| WO | WO 2006/044875 | A1 | 4/2006 |
| WO | WO 2011/087974 | A1 | 7/2011 |

OTHER PUBLICATIONS

Paul Becher, "Emulsions—Theory and Practice", 3rd ed., American Chemical Society and Oxford University Press, NY, NY, 2001, Chapter 12, pp. 373-428.*

(Continued)

*Primary Examiner* — John Hardee

(74) *Attorney, Agent, or Firm* — James F. McBride; Steven W. Miller

(57) ABSTRACT

The present invention is directed to fluid fabric enhancing compositions and processes of making and using same. Such fluid fabric enhancing compositions have a desirable fabric enhancer active efficiency that is, at least in part, due to the particle index of such fluid fabric enhancing compositions. Certain chemical processing and physical processing methods are not required to produce such compositions.

3 Claims, 3 Drawing Sheets

(56) References Cited

U.S. PATENT DOCUMENTS

| | | | | |
|---|---|---|---|---|
| 4,911,852 | A | 3/1990 | Coffindaffer et al. | |
| 5,296,622 | A | 3/1994 | Uphues et al. | |
| 5,807,956 | A | 9/1998 | Czech | |
| 5,981,681 | A | 11/1999 | Czech | |
| 6,207,782 | B1 | 3/2001 | Czech et al. | |
| 6,482,969 | B1 | 11/2002 | Helmrick et al. | |
| 6,607,717 | B1 | 8/2003 | Johnson et al. | |
| 6,903,061 | B2 | 6/2005 | Masschelein et al. | |
| 7,041,767 | B2 | 5/2006 | Lange et al. | |
| 7,217,777 | B2 | 5/2007 | Lange et al. | |
| 7,273,837 | B2 | 9/2007 | Boutique et al. | |
| 7,335,630 | B2 | 2/2008 | Delplancke et al. | |
| 7,465,439 | B2 | 12/2008 | Avery et al. | |
| 7,833,961 | B2 | 11/2010 | Declercq et al. | |
| 8,207,105 | B2 | 6/2012 | Panandiker et al. | |
| 8,263,543 | B2 | 9/2012 | Panandiker et al. | |
| 8,322,910 | B2 * | 12/2012 | Gansmuller | B01F 5/0682 366/173.1 |
| 8,759,278 | B2 * | 6/2014 | Corominas | B01F 3/0807 510/522 |
| 2003/0069158 | A1 * | 4/2003 | Ilett | C11D 1/62 510/329 |
| 2005/0048549 | A1 | 3/2005 | Cao et al. | |
| 2005/0098759 | A1 | 5/2005 | Frankenbach et al. | |
| 2005/0164905 | A1 | 7/2005 | Chawla et al. | |
| 2005/0170994 | A1 | 8/2005 | Casado-Dominguez et al. | |
| 2006/0252668 | A1 | 11/2006 | Frankenbach et al. | |
| 2007/0041929 | A1 | 2/2007 | Torgerson et al. | |
| 2007/0286837 | A1 | 12/2007 | Torgerson et al. | |
| 2009/0042767 | A1 | 2/2009 | Gizaw et al. | |
| 2012/0302488 | A1 | 11/2012 | Panandiker et al. | |
| 2013/0109612 | A1 | 5/2013 | Corona, III et al. | |

OTHER PUBLICATIONS

International Search Report; International Application No. PCT/US2012/061761; Date of mailing Mar. 5, 2013; 14 pages.

Calero, Nuria et al.; Rheological and Microstructural Behavior of a Model Concentrated Fabric Softener; Chem. Eng. Technol.; 2011; pp. 1473-1480; vol. 34; No. 9; XP-002692456.

Soubiran, L. et al.; Effects of Shear on the Lamellar Phase of a Dialkyl Cationic Surfactant; Langmuir; 2001; pp. 7988-7994; vol. 17; No. 26; XP-002692457.

Partal, P. et al.; Rheology and Microstructural Transitions in the Lamellar Phase of a Cationic Surfactant; Langmuir; 2001; pp. 1331-1337; vol. 17; No. 5; XP-002692458.

Reid, V. W., et al., Determination of Anionic-Active Detergents by Two-phase Titration, Tenside, 1967, pp. 292-304, vol. 4, Heft 9.

Saveyn, Pieter, et al., Osmotic effects on the enclosed volume and interlamellar spacing of multilamellar DODAC vesicles, Colloids and Surfaces A: Physiochem. Eng. Aspects, Apr. 15, 2008, pp. 62-70, vol. 319, Issue 1-3.

Bhattcharya, Santanu, et al., Synthesis, Thermotropic Behavior, and Permeability Properties of Vesicular Membranes Composed of Cationic Mixed-Chain Surfactants, Langmuir, 1995, pp. 4748-4757, vol. 11, No. 12.

* cited by examiner

Figure 3 Apparatus B Example
Circulation Loop System
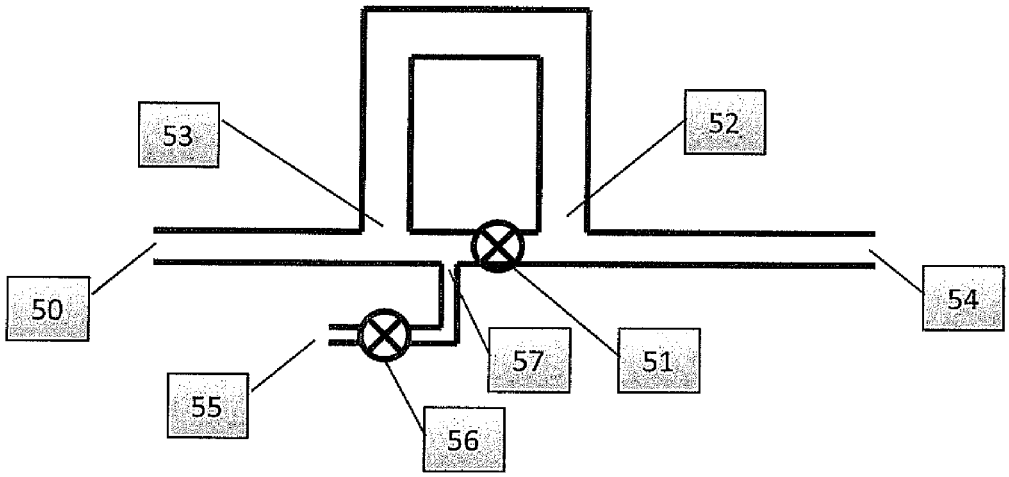

FABRIC CARE COMPOSITIONS

This is a continuation of U.S. patent application Ser. No. 13/659,943, filed Oct. 25, 2012, now abandoned.

FIELD OF THE INVENTION

The present invention is directed to fluid fabric enhancing compositions and processes of making and using same.

BACKGROUND OF THE INVENTION

Current fluid fabric enhancers do not exhibit the desired fabric enhancer active efficiency. Applicants recognized that a key source of such lack of efficiency was rooted in the particulate size of the enhancing active in the fluid fabric enhancer. While not being bound by theory, Applicants believe that current fluid fabric enhancers comprise fabric enhancer active particles that are essentially spherical. As a sphere is the geometric shape with the least surface area per unit mass, only a small portion of the fabric enhancer can contact a desired surface, such as the surface of a garment. Unfortunately, other geometric shapes are not as thermodynamically favored or they cause problems such as excessive viscosity. Applicants recognized that the fabric enhancer active efficiency problem can be solved, to a degree, if fabric enhancer active particulate surface area per unit mass is increased. Thus, Applicants decreased the particulate size of the fabric enhancer active while retaining the essentially spherical shape of the fabric enhancer particulates. Finally, Applicants recognized that when raw material costs, processing costs and fabric enhancer active efficiency are taken as a whole, the fabric enhancer active particulates disclosed herein are desired. This is particularly true as certain chemical processing methods, for example use of additives such as nonionic surfactants and fatty alcohols and high energy physical processing methods, for example sonolation, are not required to produce Applicants fluid fabric enhancer compositions.

SUMMARY OF THE INVENTION

The present invention is directed to fluid fabric enhancing compositions and processes of making and using same. Such fluid fabric enhancing compositions have a desirable fabric enhancer active efficiency.

DETAILED DESCRIPTION OF THE INVENTION

Figure 1:
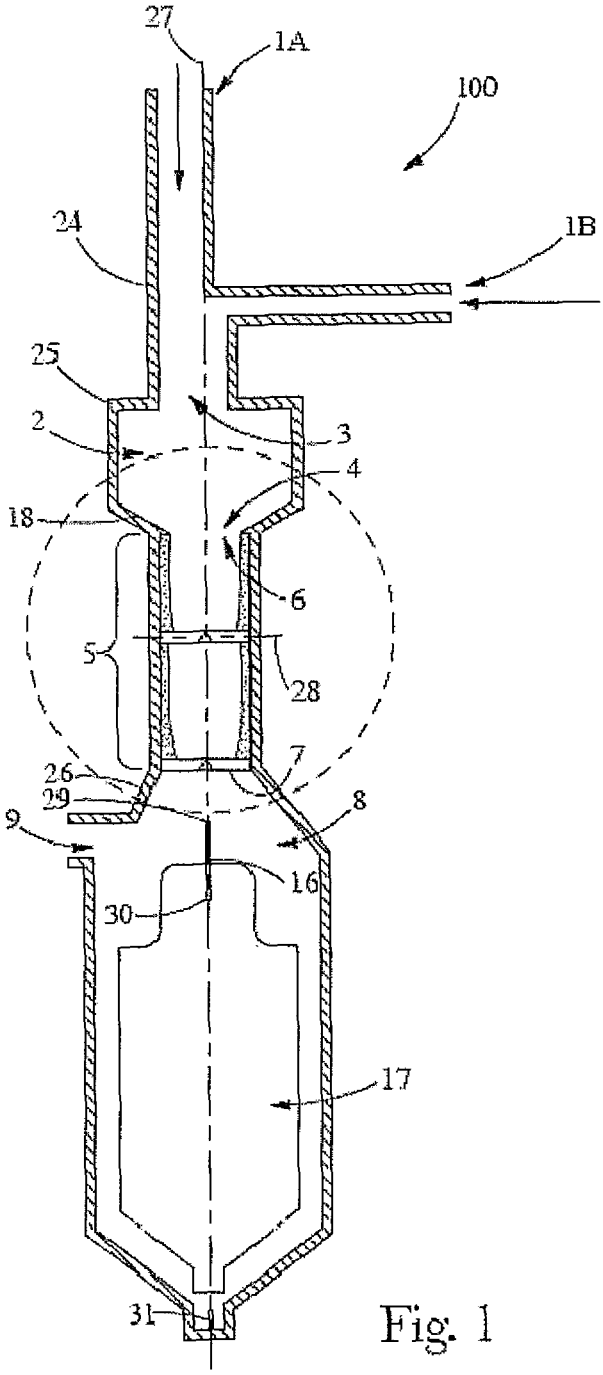
FIG. 1 details the apparatus A used in the process of the present invention

In the context of the present invention, the terms "a" and "an" mean at "at least one".

When describing the "two orifices" or "two orifice units" of the present invention, we herein mean "at least two orifices" or "at least two orifice units".

By "shear" we herein mean, a strain produced by pressure in the structure of a substance, when its layers are laterally shifted in relation to each other.

By "turbulence" we herein mean, the irregular and disordered flow of fluids.

By "operating pressure" we herein mean the pressure of the liquid(s) in the pre-mix chamber 2.

By "cavitation" we herein mean, the formation of bubbles in a liquid due to the hydrodynamics of the liquid and the collapsing of those bubbles further downstream.

As used herein, the terms "include", "includes" and "including" are meant to be non-limiting.

As used herein, the term "fluid" includes liquid, gel, and paste forms.

As used herein, the term "situs" includes paper products, fabrics, garments, hard surfaces, hair and skin.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fluid Fabric Enhancers

In one aspect, a liquid fabric enhancer composition comprising one or more fabric enhancer actives, said one or more fabric enhancer actives comprising particles, said particles having, based on said liquid fabric enhancer composition's total fabric enhancer active, a particle index as measured on a Nanosights NS500 using a laser with an output of 75 mW at 532 nm from about 750 to about 3000, from about 800 to about 2500 from about 810 to about 2000:

a. from 4% to about 30%, from about 5% to about 25% from about 6% to about 20% or even from about 8% to about 18% of a particulate fabric enhancer active comprising an amine moiety;
b. from about 1 ppm to 5000 ppm, from about 10 ppm to about 5000 ppm, from about 50 ppm to about 4000 ppm, from about 100 ppm to about 3000 ppm or from about 100 ppm to about 2000 ppm of a electrolyte;
c. from about 60 to about 96%, from about 60% to about 90%, from about 70% to about 90%, of a carrier comprising water; and
d. optionally, one or more adjunct ingredients.

In one aspect, said liquid fabric enhancer composition may have a pH from about 2 to about 12, from about 2 to about 10, from about 2 to about 9, from about 2 to about 8.

In one aspect, said liquid fabric enhancer composition may have a pH from about 2 to about 8, from about 2.5 to about 5, from about 2.5 to about 3.5, and may comprise a fabric enhancer active comprising an ester quaternary ammonium compound.

In one aspect, said ester quaternary ammonium compound may be selected from the group consisting of mono esters of acyl-oxyethyl-N,N-dimethylammonium chloride, diesters of acyl-oxyethyl-N,N-dimethylammonium chloride and mixtures thereof.

In one aspect, said mono esters of acyl-oxyethyl-N,N-dimethylammonium chloride, and diesters of acyl-oxyethyl-N,N-dimethylammonium chloride mono may have a iodine value from about 0-60, from about 0-40, from about 10-30, from about 15-25.

In one aspect, said liquid fabric enhancer composition may comprise one or more adjunct ingredients said one or more adjunct ingredients being selected from the group consisting of: additional fabric softener actives, silicone, organosilicones, structurants, deposition aids, perfumes, encapsulated perfumes, dispersing agents, stabilizers, pH control agents, colorants, brighteners, dyes, odor control agent, pro-perfumes, cyclodextrin, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants and mixtures thereof.

Method of Use

A method of treating and/or cleaning a situs, said method comprising a.) optionally washing and/or rinsing said situs;

b.) contacting said situs with a liquid fabric enhancer composition disclosed; and c.) optionally washing and/or rinsing said situs.

d.) optionally drying said situs via and automatic dryer and/or line drying.

Process and Apparatus

The present invention is directed to a process for making a fabric enhancing composition using an apparatus for mixing the liquid fabric enhancing composition components by producing shear, turbulence and/or cavitation. It should be understood that, in certain embodiments, the ability of the process to induce shear may not only be useful for mixing, but may also be useful for dispersion of solid particles in liquids, liquid in liquid dispersions and in breaking up solid particles. In certain embodiments, the ability of the process to induce shear and/or produce cavitation may also be useful for droplet and/or vesicle formation.

In one aspect, process of making a fluid composition comprising:

combining a plurality of fluids in an apparatus, said apparatus comprising several sections defined as apparatus A and apparatus B: apparatus A comprising one or more inlets (1A) and one or more inlets (1B), said one or more inlets (1A) and said one or more inlets (1B) being in fluid communication with one or more suitable liquid transporting devices; a pre-mixing chamber (2), the pre-mixing chamber (2) having an upstream end (3) and a downstream end (4), the upstream end (3) of the pre-mixing chamber (2) being in liquid communication with said one or more inlets (1A) and said one or more inlets (1B); an orifice component (5), the orifice component (5) having an upstream end (6) and a downstream end (7), the upstream end of the orifice component (6) being in liquid communication with the downstream end (4) of the pre-mixing chamber (2), wherein the orifice component (5) is configured to spray liquid in a jet and produce shear, turbulence and/or cavitation in the liquid; a secondary mixing chamber (8), the secondary mixing chamber (8) being in liquid communication with the downstream end (7) of the orifice component (5); at least one outlet (9) in liquid communication with the secondary mixing chamber (8) for discharge of liquid following the production of shear, turbulence and/or cavitation in the liquid, the at least one outlet (9) being located at the downstream end of the secondary mixing chamber (8); the orifice component (5) comprising at least two orifice units, (10) and (11) arranged in series to one another and each orifice unit comprises an orifice plate (12) comprising at least one orifice (13), an orifice chamber (14) located upstream from the orifice plate (12) and in liquid communication with the orifice plate (12); and wherein neighboring orifice plates are distinct from each other;

wherein said combining is achieved by applying a force from about 0.1 bar to about 50 bar, from about 0.5 bar to about 10 bar, from about 1 bar to about 6 bar to said plurality of fluids, said force being applied by said transportation devices then applying a shearing energy in apparatus B from about 10 g/cm $s^2$ to about 1,000,000 g/cm $s^2$, from about 50 g/cm $s^2$ to about 500,000 g/cm $s^2$ from about 100 g/cm $s^2$ to about 100,000 g/cm $s^2$, for a residence time from about 0.1 seconds to about 10 minutes, from about 1 second to about 1 minute, from about 2 seconds to about 30 seconds to said combined plurality of fluids.

optionally, heating individual and/or combined fluids from inlets 1A and/or 1B before, during or after shearing step, to temperatures from about 15° C. to about 95° C., from about 20° C. to about 80° C. or from about 40° C. to about 80° C.

optionally cooling said combined plurality of fluids, during and/or after said shearing step, to temperatures from about 5° C. to about 45° C., from about 10° C. to about 35° C., from about 15° C. to about 30° C., from about 20° C. to about 25° C.

adding a electrolyte, in one aspect, a fluid comprising a electrolyte, to said combined plurality of fluids during said combining and/or said shearing step. Typically, when the fluid fabric enhancer's concentration in the product being processed exceeds about 6%, the electrolyte is added. optionally, adding in one or more adjunct ingredients to said plurality of fluids and/or combined plurality of fluids.

optionally, recycling said combined plurality of fluids through one or more portions of said process is disclosed.

In one aspect of said process, the fabric enhancing active is present between 50% and 100% by weight of the fabric enhancing active composition.

In one aspect of said process, the process is operated without cavitation, instead said process is operated such that there is shear and/or turbulence. In short, in any of the aforementioned processes such processes and equipment can be operated such that there is only shear and/or turbulence.

The Apparatus A

FIG. 1 shows one embodiment of an apparatus A for mixing liquids by producing shear, turbulence and/or cavitation, said apparatus comprising, at least one inlet 1A and a pre-mixing chamber 2. Not to be bound by theory, Applicants believe the degree of mixing in the pre-mixing chamber has an effect on the particle size distribution of the dispersion. In one aspect, the feed configuration adds the active in a way to minimize premixing and heat transfer prior to the first orifice plate. This is accomplished in two ways: First, the residence time in the premixing chamber is from about 1 ms to 1 sec, from about 2 ms to 500 ms, from about 3 ms to 250 ms. Second, the active is introduced inline with the solvent flow, directed down the axial centerline, and towards the center of the orifice opening. This allows the active to encounter high extensional strain rates to create a small dispersion, while minimizing premixing which can be detrimental, The pre-mixing chamber has an upstream end 3 and a downstream end 4, the upstream end 4 being in liquid communication with the at least one inlet 1A. The apparatus A also comprises an orifice component 5, the orifice component 5 having an upstream end 6 and a downstream end 7. The upstream end of the orifice component 6 is in liquid communication with the downstream end 4 of the pre-mixing chamber 2, and the orifice component 5 is configured to spray liquid in the form of a jet and produce shear or cavitation in the liquid. A secondary mixing chamber 8 is in liquid communication with the downstream end 7 of the orifice component 5. At least one outlet 9 communicates with the secondary mixing chamber 8 for discharge of liquid following the production of shear, turbulence or cavitation in the liquid, and is located at the downstream end of the secondary mixing chamber 8.

A liquid(s) can be introduced into the inlet 1A at a desired operating pressure. The liquid can be introduced at a desired operating pressure using standard liquid pumping devices. The liquid flows from the inlet into the pre-mix chamber 2 and then into the orifice component 5. The liquid will then exit the orifice component 5 into the secondary mixing chamber 8, before exiting the apparatus A through the outlet 9.

Figure 2:
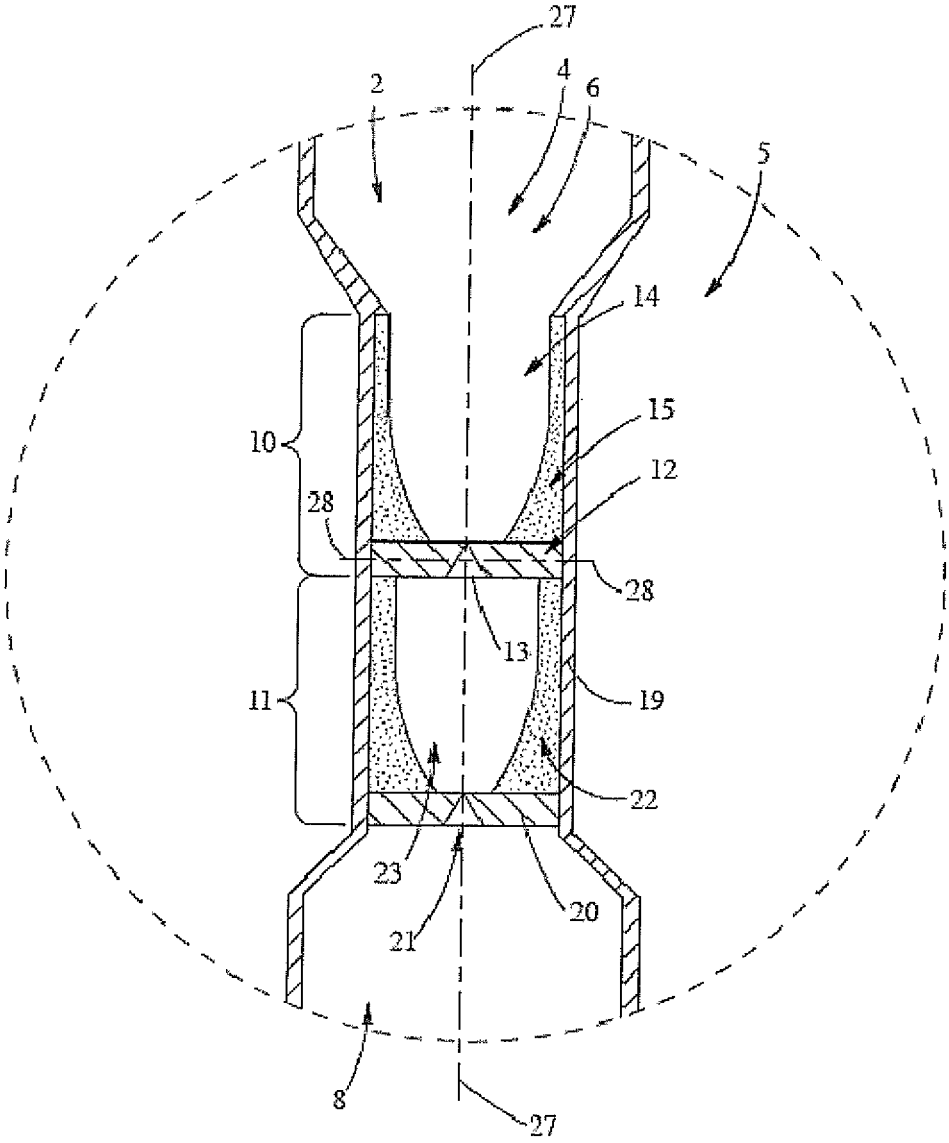
FIG. 2 details the orifice component 5 of the apparatus used in the method of the present invention FIG. 3 details the apparatus B used in the process of the present invention

As can be seen in FIG. 2, the orifice component comprises at least two orifice units 10 and 11 arranged in series to one another. Each orifice unit comprises an orifice plate 12 comprising at least one orifice 13, an orifice chamber 14 located upstream from the orifice plate and in liquid communication with the orifice plate. In one embodiment, the orifice unit 10 further comprises an orifice bracket 15 located adjacent to and upstream from the orifice plate 12, the walls of the orifice bracket 15 defining a passageway through the orifice chamber 14.

In another embodiment, the apparatus A comprises at least 5 orifice units arranged in series. In yet another embodiment, the apparatus A comprises at least 10 orifice units arranged in series.

During shearing in Apparatus A, the temperature of said fluid may be controlled or changed depending on the transformation requirements. In one embodiment, it may be useful to alter said fluid temperature within apparatus A. Said fluid temperature change may be accomplished by means known to those in the fluid processing industry and may include but are not limited to heat exchangers, pipe jackets, and injection of one or more additional hotter or colder optional adjunct fluids into said fluid.

Orifice Alignment

For the purpose of creating a uniform, small dispersion of active, for example fabric softener, in a solvent, for example water, the orifice plates are particularly effective when aligned axially, and centered near the region of high active concentration. While not being bound by theory, Applicants believe that this allows the active material to pass primarily through the region of high extensional strain rate, while minimizing bulk mixing prior to dispersion, which can have a detrimental effect on creating small particle size dispersions. In addition, the orifices are ideally placed in the center of the pipe, which Applicants believe creates a uniform turbulence distribution throughout the device, so all particles experience a uniform energy input.

In one aspect, the orifice alignment is such that the orifice plates are aligned axially, with the center of each plate offset from the centerline by zero percent, no more than 1%, no more than 5%, no more than 10%, or no more than 25% of the pipe diameter.

In one aspect, the plates are offset by less than 5% of the pipe diameter, which further minimizes bulk mixing while still allowing the active to experience high extensional strain rates necessary for a small dispersion. Proper plate alignment also minimizes pressure losses, so the dispersion can be made at low energy inputs.

The apparatus A may, but need not, further comprise at least one blade 16, such as a knife-like blade, disposed in the secondary mixing chamber 8 opposite the orifice component 5.

The components of the present apparatus A can include an injector component, an inlet housing 24, a pre-mixing chamber housing 25, an orifice component housing 19, the orifice component 5, a secondary mixing chamber housing 26, a blade holder 17, and an adjustment component 31 for adjusting the distance between the tip of blade 16 and the discharge of the orifice component 5. It may also be desirable for there to be a throttling valve (which may be external to the apparatus A) that is located downstream of the secondary mixing chamber 8 to vary the pressure in the secondary mixing chamber 8. The inlet housing 24, pre-mixing chamber housing 25, and secondary mixing chamber housing 26 can be in any suitable configurations. Suitable configurations include, but are not limited to cylindrical, configurations that have elliptical, or other suitable shaped cross-sections. The configurations of each of these components need not be the same. In one embodiment, these components generally comprise cylindrical elements that have substantially cylindrical inner surfaces and generally cylindrical outer surfaces.

These components can be made of any suitable material(s), including but not limited to stainless steel, AL6XN, Hastalloy, and titanium. It may be desirable that at least portions of the blade 16 and orifice component 5 to be made of materials with higher surface hardness or higher hardnesses. The components of the apparatus 100 can be made in any suitable manner, including but not limited to, by machining the same out of solid blocks of the materials described above. The components may be joined or held together in any suitable manner.

The various elements of the apparatus A has described herein, are joined together. The term "joined", as used in this specification, encompasses configurations in which an element is directly secured to another element by affixing the element directly to the other element; configurations in which the element is indirectly secured to the other element by affixing the element to intermediate member(s) which in turn are affixed to the other element; configurations where one element is held by another element; and configurations in which one element is integral with another element, i.e., one element is essentially part of the other element. In certain embodiments, it may be desirable for at least some of the components described herein to be provided with threaded, clamped, or pressed connections for joining the same together. One or more of the components described herein can, for example, be clamped, held together by pins, or configured to fit within another component.

The apparatus A comprises at least one inlet 1A, and typically comprises two or more inlets, such as inlets 1A and 1B, so that more than one material can be fed into the apparatus A. The inlets 1A and 1B may be configured in a variety of shapes and types known by one of ordinary skill in the art such as a t-shape, y-shape, injector type where one inlet is positioned in the centerline of the premixing chamber, The apparatus A can comprise any suitable number of inlets so that any of such numbers of different materials can be fed into the apparatus A. In another embodiment, a pre-mix of two liquids can be introduced into just one inlet of the apparatus A. This pre-mix is then subjected to shear, turbulence and/or cavitation as it is fed through the apparatus A.

The apparatus A may also comprise at least one drain, or at least one dual purpose, bidirectional flow conduit that serves as both an inlet and drain. The inlets and any drains may be disposed in any suitable orientation relative to the remainder of the apparatus A. The inlets and any drains may, for example, be axially, radially, or tangentially oriented relative to the remainder of the apparatus A. They may form any suitable angle relative the longitudinal axis of the apparatus A. The inlets and any drains may be disposed on the sides of the apparatus. If the inlets and drains are disposed on the sides of the apparatus, they can be in any suitable orientation relative to the remainder of the apparatus.

In one embodiment the apparatus A comprises one inlet 1A in the form of an injector component that is axially oriented relative to the remainder of the apparatus. The injector component comprises an inlet for a first material.

The pre-mixing chamber 2 has an upstream end 3, a downstream end 4, and interior walls. In certain embodiments, it may further be desirable for at least a portion of the pre-mixing chamber 2 to be provided with an initial axially symmetrical constriction zone 18 that is tapered (prior to the location of the downstream end of the injector) so that the size (e.g. diameter) of the upstream mixing chamber 2 becomes smaller toward the downstream end 4 of the pre-mixing chamber 2 as the orifice component 5 is approached.

The orifice component 5 can be in any suitable configuration. In some embodiments, the orifice component 5 can comprise a single component. In other embodiments, the orifice component 5 can comprise one or more components of an orifice component system. One embodiment of an orifice component system 5 is shown in greater detail in FIG. 2.

The apparatus comprises an orifice component 5, wherein the orifice component comprises at least a first orifice unit 10 and a second orifice unit 11.

In the embodiment shown in FIG. 2 the orifice component 5 comprises an orifice component housing 19. The first orifice unit 10 comprises a first orifice plate 12 comprising a first orifice 13 and a first orifice chamber 14. In one embodiment, the first orifice unit 10 further comprises a first orifice bracket 15. The second orifice unit 11 also comprises a second orifice plate 20 comprising a second orifice 21, a second orifice chamber 23 and optionally a second orifice bracket 22. Looking at these components in greater detail, the orifice component housing 19 is a generally cylindrically-shaped component having side walls and an open upstream end 6, and a substantially closed (with the exception of the opening for the second orifice 21) downstream end 7.

Looking now at the first orifice unit 10, the orifice chamber 14 is located upstream from, and in liquid communication with, the orifice plate 12. The first orifice bracket 15 is sized and configured to fit inside the orifice component housing 9 adjacent to, and upstream of, the first orifice plate 12 to hold the first orifice plate 12 in place within the orifice component housing 9. The first orifice bracket 15 has interior walls which define a passageway through the first orifice chamber 14.

The second orifice unit 11 is substantially the same construction as the first orifice unit 10.

The orifice units 10 and 11 are arranged in series within the orifice component 5. Any number of orifice units can be arranged in series within the orifice component 5. Each orifice plate can comprise at least one orifice. The orifices can be arranged anywhere upon the orifice plate, providing they allow the flow of liquids through the apparatus A. Each orifice plate can comprise at least one orifice arranged in a different orientation than the next orifice plate. In one embodiment, each orifice plate comprises at least one orifice that is arranged so that it is off-centered as compared to the orifice in the neighbouring orifice plate. In one embodiment, the size of the orifice within the orifice plate can be adjusted in situ to make it bigger or smaller, i.e. without changing or removing the orifice plate.

The first orifice bracket 15 and second orifice bracket 22, can be of any suitable shape or size, providing they secure the first orifice plates during operation of the apparatus A. FIGS. 1 and 2 show an example of the orientation and size of an orifice bracket 22. In another embodiment, the orifice bracket 22 may extend only half the distance between the second orifice plate 20 and the first orifice plate 12. In yet another embodiment, the second orifice bracket 22 may extend only a quarter of the distance between the second orifice plate 20 and the first orifice plate 12.

In one embodiment, the orifice plate 12 is hinged so that it can be turned 90° about its central axis. The central axis can be any central axis, providing it is perpendicular to the centre-line 27, which runs along the length of the apparatus A. In one embodiment, the central-axis can be along the axis line 28. By allowing the orifice 12 to be moved 90° about its central axis, build up of excess material in the first orifice chamber 14 and/or second orifice chamber 23 can be more readily removed. In one embodiment, the size and/or orientation of the first orifice bracket 15 can be adjusted to allow the rotation of the first orifice plate 12. For example, in one embodiment, the first orifice bracket 15 can be unsecured and moved in an upstream direction away from the first orifice plate 12 towards the pre-mixing chamber 2. The orifice plate 12 can then be unsecured and rotated through 90°. Once the apparatus A is clean, the first orifice plate 12 can be returned to its original operating configuration and then if present, the first orifice bracket 15 returned to its original operating position. The second orifice plate 20 and also any extra orifice plates present, may also be hinged. The second orifice bracket 22 and any other orifice brackets present may also be adjustable in the manner as described for the first orifice bracket 15.

Any two orifice plates must be distinct from one another. In other words neighbouring orifice plates must not be touching. By "neighbouring", we herein mean the next orifice plate in series. If two neighbouring plates are touching, mixing of liquids between orifices is not achievable. In one embodiment, the distance between the first orifice plate 12 and the second orifice plate 20 is equal to or greater than 1 mm.

The elements of the orifice component 5 form a channel defined by walls having a substantially continuous inner surface. As a result, the orifice component 5 has few, if any, crevices between elements and may be easier to clean than prior devices. Any joints between adjacent elements can be highly machined by mechanical seam techniques, such as electro polishing or lapping such that liquids cannot enter the seams between such elements even under high pressures.

The orifice component 5, and the components thereof, can be made of any suitable material or materials. Suitable materials include, but are not limited to stainless steel, tool steel, titanium, cemented tungsten carbide, diamond (e.g., bulk diamond) (natural and synthetic), and coatings of any of the above materials, including but not limited to diamond-coated materials.

The orifice component 5, and the elements thereof, can be formed in any suitable manner. Any of the elements of the orifice component 5 can be formed from solid pieces of the materials described above which are available in bulk form.

The elements may also be formed of a solid piece of one of the materials specified above, which may or may not be coated over at least a portion of its surface with one or more different materials specified above. Since the apparatus A requires lower operating pressures than other shear, turbulence and/or cavitation devices, it is less prone to erosion of its internal elements due to mechanical and/or chemical wear at high pressures. This means that it may not require expensive coating, such as diamond-coating, of its internal elements.

In other embodiments, the orifice component 5 with the first orifice 13 and the second orifice 21 therein can comprise a single component having any suitable configuration, such as the configuration of the orifice component shown in FIG. 2. Such a single component could be made of any suitable material including, but not limited to, stainless steel. In other embodiments, two or more of the elements of the orifice component 5 described above could be formed as a single component.

The first orifice 13 and second orifice 21 are configured, either alone, or in combination with some other component, to mix the fluids and/or produce shear, turbulence and/or cavitation in the fluid(s), or the mixture of the fluids. The first orifice 13 and second orifice 21 can each be of any suitable configuration. Suitable configurations include, but are not limited to slot-shaped, eye-shaped, cat eye-shaped, elliptically-shaped, triangular, square, rectangular, in the shape of any other polygon, or circular.

The blade 16 has a front portion comprising a leading edge 29, and a rear portion comprising a trailing edge 30. The blade 16 also has an upper surface, a lower surface, and a thickness, measured between the upper and lower surfaces. In addition, the blade 16 has a pair of side edges and a width, measured between the side edges.

As shown in FIG. 1, when the blade 16 is inserted into the apparatus A, a portion of the rear portion of the blade 16 is clamped, or otherwise joined inside the apparatus so that its position is fixed. The blade 16 can be configured in any suitable manner so that it can be joined to the inside of the apparatus.

As shown in FIG. 1, in some embodiments, the apparatus 16 may comprise a blade holder 17.

The apparatus A comprises at least one outlet or discharge port 9.

The apparatus A may comprise one or more extra inlets. These extra inlets can be positioned anywhere on the apparatus A and may allow for the addition of extra liquids. In one embodiment, the second orifice unit comprises an extra inlet. In another embodiment, the secondary mixing chamber comprises an extra inlet. This allows for the addition of an extra liquid to be added to liquids that have exited the orifice component 5.

It is also desirable that the interior of the apparatus A be substantially free of any crevices, nooks, and crannies so that the apparatus A will be more easily cleanable between uses. In one embodiment of the apparatus A described herein, the orifice component 5 comprises several elements that are formed into an integral structure. This integral orifice component 5 structure fits as a unit into the pre-mixing chamber housing and requires no backing block to retain the same in place, eliminating such crevices.

Numerous other embodiments of the apparatus A and components therefore are possible as well. The blade holder 17 could be configured to hold more than one blade 16. For example, the blade holder 17 could be configured to hold two or more blades.

Apparatus B

Applicants have found it is desirable to subject said fluid from said outlet 9 of Apparatus A, to additional shear and/or turbulence for a period of time within Apparatus B to transform said liquid into a desired microstructure. Shear or turbulence imparted to said fluid may be quantified by estimating the total kinetic energy per unit fluid volume. The total kinetic energy imparted to the fluid is the sum total of the kinetic energy per unit fluid volume times the residence time as said fluid flows through each of the conduits, pumps, and in-line shearing or turbulence devices that the fluid experiences.)

In one aspect, Apparatus B may comprise one or more inlets for the addition of adjunct ingredients.

In one embodiment of Apparatus B, one or more Circulation Loop Systems are in fluid communication to said outlet 9 of Apparatus A. Said Circulation Loop systems may be arranged in series or in parallel. Said fluid from outlet 9 of Apparatus A is fed to one or more Circulation Loop Systems, composed of one or more fluid inlets, connected to one or more circulation system pumps, one or more circulation loop conduits of a specified cross sectional areas and lengths, one or more connections from said circulating loop conduits to said inlet of one or more circulation pumps, and one or more fluid outlets, connected to said circulation loop system conduits. It is recognized that one or more conduits may be necessary to achieve the desired residence time. One or more bends or elbows in said conduits may be useful to minimize floor space.

An example of said Circulation Loop Systems is shown if FIG. 3. Said fluid from Apparatus A outlet 9 is fed to a single Circulation Loop System comprising a fluid inlet, 50, in fluid communication with a circulation loop system pump, 51, in fluid communication with a circulation system loop conduit of a specified cross sectional area and length, 52, in fluid communication with a fluid connection, 53, from said circulating loop conduit 52 to said inlet of said circulation pump 51, and a fluid outlet, 54, in fluid communication with said circulation loop conduit, 52. In said embodiment, said fluid inlet flow rate is equal to the fluid outlet flow rate. Said Circulation Loop System has a Circulation Loop Flow Rate equal to or greater than said inlet or outlet flow rate into or out of said Circulation Loop System. The Circulating Loop System may be characterized by a Circulation Flow Rate Ratio equal to the Circulation Flow Rate divided by the Inlet or Outlet Flow Rate.

Said Circulation Loop System example has one or more conduit lengths and diameters and pumps arranged in a manner that imparts shear or turbulence to the fluid. The circulation loop conduits may be in fluid communication with one or more devices to impart shear or turbulence to said fluid including but not limited to static mixers, orifices, flow restricting valves, and/or in-line motor driven milling devices as those supplied by IKA, Staufen and devices known in the art. It is recognized that one or more bends or elbows in said conduits may be useful to deliver the desired kinetic energy and residence time while minimizing floor space. The duration of time said fluid spends in said Circulation Loop System example may be quantified by a Residence Time equal to the total volume of said Circulation Loop System divided by said fluid inlet or outlet flow rate.

In another embodiment, Apparatus B may be comprised of one or more continuously operated tanks arranged either in series or in parallel. The fluid from Apparatus A outlet 9 is in fluid communication and continuously fed to an tank of suitable volume and geometry. In a example, said fluid enters and leaves said tank at identical flow rates. The residence time of said fluid in said tanks is equal to the volume of fluid in said tanks divided by the inlet or outlet flow rates. Said tanks may be fitted with one or more agitation devices such as mixers consisting of one or more impellers attached to one or more shafts that are driven by one or more motors. The agitation device maybe also be one or more tank milling devices such as those supplied by IKA, Staufen, Germany, including batch jet mixers and rotor-stator mills. The tank may be fitted with one or more baffles to enhance mixing shear or turbulence within the tank. The tank may consist of a means to control the fluid temperature within the tank using but not limited to internal coils or a wall jacket containing a circulating cooling or heating fluid.

The tank may also have an external circulation system that provides additional kinetic energy per unit fluid volume and residence time. Said external circulating system may consist but is not limited to one or more tank outlet conduits, one or more motor driven fluid pumps, one or more static shearing devices, one or more motor driven shearing mills, one or more inlet circulation conduits returning the fluid back to the tank all in fluid communication and may be arranged in series or parallel.

In another embodiment of Apparatus B, one or more of said tanks may be filled with fluid and held in the tank with mixing and or circulation as described above to impart kinetic energy per unit fluid volume for a desired residence time and then removed from an outlet from the tank.

In another embodiment of Apparatus B, one or more conduits may be used to impart shear or turbulence to a fluid for a desired residence time. The conduit may be in fluid communication with but not limited to one or more motor driven fluid pumps, one or more static shearing devices, one or more motor driven shearing mills, arranged in any order in series or parallel. It is recognized that one or more long conduits may be necessary to achieve the desired residence time. One or move bends or elbows in said conduits may be useful to minimize floor space.

During said shearing and turbulence within Apparatus B, one or more optional adjunct fluids may be added to said fluids to help create the desired fluid microstructure. Addition of said optional adjunct fluids to said fluid may be accomplished by means known to those in the fluid processing industry and added anywhere in Apparatus B. Not bound by theory, one or more optional adjunct fluids may be added at a point in Apparatus B that insures uniform dispersion and mixing of said optional adjunct fluid with said fluid. In one embodiment in the Continuous Loop System example above, said optional adjunct fluids may be introduced at an inlet, 55, by means of a pump, 56, to an injector, 57, in fluid communication with the continuous loop pump, 51, inlet. Additionally, said optional adjunct fluid also may also be added at, but not limited to, said continuous loop inlet, 50, and or in said circulation loop conduit, 52, and or simultaneously in any combination of addition points.

During shearing in Apparatus B, the temperature of said fluid may be controlled or changed depending on the transformation requirements. In one embodiment, it may be useful to alter said fluid temperature within apparatus B. Said fluid temperature change may be accomplished by means known to those in the fluid processing industry and may include but are not limited to heat exchangers, pipe jackets, and injection of one or more additional hotter or colder optional adjunct fluids into said fluid.

In one aspect, the fluid communication between the outlet of Apparatus A and the inlet of Apparatus B, may be limited to a fluid residence time of less than about 10 minutes, less than about 1 minute, less than about 20 seconds, less than about 10 seconds, less than about 5 seconds, or less than about 3 seconds depending on the transformations required. In another aspect, the fluid communication between the outlet of Apparatus A and the inlet of Apparatus B, may be limited to a fluid residence time of from about 0.01 seconds to about 10 minutes.

Said fluid inlets and outlets of said Apparatus B may be in fluid communication with one or more other devices. These devices include but are not limited to a means of regulating the temperature of said fluid including but not limited to heat exchangers, means of regulating Apparatus B pressure including but not limited to pressure control valves and booster pumps, means of removing contaminants from said fluid including but not limited to filtration devices, means of adding one or more adjunct ingredients to said fluid from but not limited to adjunct ingredient delivery systems, means of monitoring process control features including but not limited to flow, pressure and temperature gauges and transmitters, sampling valves and means of cleaning and sanitization.

Applicants believe, although not bound by theory, that Apparatus B should be designed to impart a uniformly consistent kinetic energy over a period of time to each fluid volume element to ensure uniformity of the desired fluid microstructure attributes.

the Fluid Fabric Enhancing Active Composition

A fluid fabric enhancing active composition is introduced into the apparatus A through the first inlet 1A. The fluid fabric enhancing active composition comprises a fabric enhancing active and a solvent.

In one embodiment, the fabric enhancing active is present at a concentration from about 2% to about 100%, from about 10% to about 100%, from about 30% to about 100%, from about 50% to about 100%, from about 75% to about 100% by weight of the fabric enhancing active composition. In addition, a fabric enhancer could be used and thus reprocessed to form a improved fluid enhancer product. The fluid fabric enhancer active composition may be heated or unheated. In one embodiment, the fluid fabric enhancer composition's temperature is from about 15° C. to about 100° C., from about 40° C. to about 90° C. or from about 70° C. to about 85° C.

In another embodiment, the fabric enhancer active comprises a quaternary ammonium compound, in one aspect, a diester quaternary ammonium compound.

In another embodiment, the fabric enhancing active composition comprises a solvent, in one aspect said solvent may be selected from the group comprising ethanol and/or isopropanol.

In another embodiment, the fabric enhancing active composition comprises an oil, in one aspect said oil may be selected from the group comprising olive oil, coconut oil, canola oil, palm oil, rapeseed oil.

Suitable fabric enhancing actives for use in the present invention are detailed below.

In one embodiment, the fabric enhancing active comprises, as the principal active, compounds of the formula $$\{R_{4-m}—N^+—[(CH_2)_n—Y—R^1]_m\}X^- \quad (1)$$

wherein each R substituent is either hydrogen, a short chain $C_1$-$C_6$, in one aspect, $C_1$-$C_3$ alkyl or hydroxyalkyl group, e.g., methyl, ethyl, propyl, hydroxyethyl, and the like, poly ($C_{2-3}$ alkoxy), in one aspect, polyethoxy, benzyl, or mixtures thereof; each m is 2 or 3; each n is from 1 to about 4, in one aspect 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, in one aspect, $C_{14}$-$C_{20}$, with each $R^1$ being a hydrocarbyl, or substituted hydrocarbyl group that contains no or some unsaturation, and $X^-$ can be any enhancer-compatible anion, in one aspect, chloride, bromide, methylsulfate, ethylsulfate, sulfate, and nitrate, in one aspect chloride or methyl sulfate; In another embodiment, the fabric enhancing active has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and in one aspect each $R^1$ is in the range of $C_{15}$ to $C_{19}$. As used herein, when the diester is specified, it can include the monoester that is present.

These types of agents and general methods of making them are disclosed in U.S. Pat. No. 4,137,180, Naik et al., issued Jan. 30, 1979, which is incorporated herein by reference. An example of a DEQA (2) is the "propyl" ester quaternary ammonium fabric enhancer active having the formula 1,2-di (acyloxy)-3-trimethylammoniopropane chloride.

In another embodiment, the fabric enhancing active has the formula:

$$[R_{4-m}—N^+—R^1{}_m]X^- \quad (3)$$

wherein each R, $R^1$, and $X^-$ have the same meanings as before.

In yet another embodiment, the fabric enhancing active has the formula:

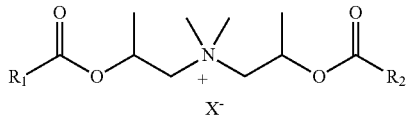

wherein each $R_1$ and $R_2$ is each independently a $C_{15}$-$C_{17}$, and wherein the $C_{15}$-$C_{17}$ is unsaturated or saturated, branched or linear, substituted or unsubstituted and $X^-$ has the definition given above.

In yet another embodiment, the fabric enhancing active has the formula:

(4)

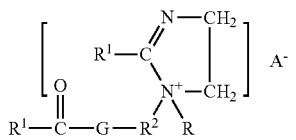

wherein each R, $R^1$, and $A^-$ have the definitions given above; each $R^2$ is a $C_{1-6}$ alkylene group, in one aspect an ethylene group; and G is an oxygen atom or an —NR— group;

In another embodiment, the fabric enhancing active has the formula:

(5)

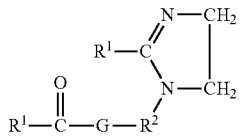

wherein $R^1$, $R^2$ and G are defined as above.

In another embodiment, the fabric enhancing actives are condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and each $R^3$ is a $C_{1-6}$ alkylene group, in one aspect, an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al., which is incorporated herein by reference;

In another embodiment, the fabric enhancing active has the formula:

$$[R^1—C(O)—NR—R^2—N(R)_2—R^3—NR—C(O)—R^1]^{30}A^- \quad (7)$$

wherein R, $R^1$, $R^2$, $R^3$ and $A^-$ are defined as above;

In yet another embodiment, the fabric enhancing active are reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

In another embodiment, the fabric enhancing active has the formula:

(9)

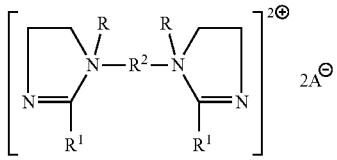

wherein R, $R^1$, $R^2$, and $A^-$ are defined as above.

Examples of compound (1) are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

Examples of compound (2) is 1,2 di(stearoyl-oxy) 3 trimethyl ammoniumpropane chloride.

Examples of Compound (3) are dialkylenedimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

An example of Compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

An example of Compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

An example of Compound (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

An example of Compound (7) is a difatty amidoamine based enhancer having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g. under the trade name Varisoft® 222LT.

An example of Compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of Compound (9) is the diquaternary compound having the formula:

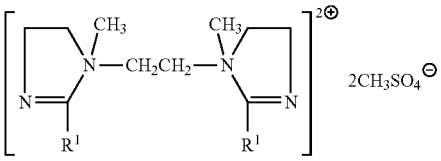

wherein $R^1$ is derived from fatty acid, and the compound is available from Witco Company.

It will be understood that combinations of enhancer actives disclosed above are suitable for use in this invention.

In the cationic nitrogenous salts herein, the anion $A^-$, which is any enhancer compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are suitable herein as anion A. The anion can also, but less preferably, carry a double charge in which case $A^-$ represents half a group.

In some embodiments, it may be desirable for the fluid fabric enhancing active composition to comprise two or more different phases, or multiple phases. The different phases can comprise one or more fluid, gas, or solid phases. In the case of fluids, it is often desirable for the fluid to contain sufficient dissolved gas for cavitation. Suitable fluids include, but are not limited to water, oil, solvents, liquefied gases, slurries, and melted materials that are ordinarily solids at room temperature. Melted solid materials include, but are not limited to waxes, organic materials, inorganic materials, polymers, fatty alcohols, and fatty acids.

The fluid fabric enhancing active can also have solid particles therein. The particles can comprise any suitable material. The particles can be of any suitable size, including macroscopic particles and nanoparticles. These particles may be present in any suitable amount in the fluid fabric enhancing active.

Second Fluid Composition

The apparatus A also comprises a second inlet 1B. The second inlet 1B is used to introduce a second fluid composition. The second fluid composition may comprise any of the general types of materials described in conjunction with the fluid fabric enhancing active that appear in fluid fabric enhancing compositions known in the art. These are exemplified below. The second fluid composition may also be heated or unheated. In one embodiment, the temperature of the second fluid composition is from about 15° C. to about 95° C., from about 20° C. to about 80° C. from about 40° C. to about 80° C., or from about 40° C. to about 70° C.

The second fluid composition may comprise adjunct ingredients selected from the group comprising, additional softener actives, silicone, organosilicones, structurants, deposition aids, perfumes, encapsulated perfumes, dispersing agents, stabilizers, pH control agents, colorants, brighteners, dyes, odor control agent, pro-perfumes, cyclodextrin, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants, electrolytes and mixtures thereof.

Suitable electrolytes for use in the present invention include alkali metal and alkaline earth metal salts such as those derived from potassium, sodium, calcium, magnesium.

The adjunct ingredients can be purchased from a variety of sources. Examples include silicones and antifoams from Dow Corning, cationic polymers such as Rheovis from BASF, cationic surfactants such as Variquat 1215 and cationic actives in the family of structure 1 from Evonik, antimicrobials such as 1,2-Benzisothiazolin-3-one-proxel from Arch Chemical and various minors from chemical supply companies such as Aldrich.

The pH of the second fluid composition should be adjusted such that the pH of the final resultant fluid fabric enhancing composition has a pH from about 1.8 to about 5, from about 2 to about 4, from about 2.5 to about 3.5, or from about 2.5 to about 3.2. This pH range increases the stability of the fabric enhancing active.

Third Fluid Composition

The apparatus B also comprises an inlet 57. The inlet 57 is used to introduce a third fluid composition. The third fluid composition may comprise any of the general types of materials described in conjunction with the fluid fabric enhancing active that appear in fluid fabric enhancing compositions known in the art. These are exemplified below. The third fluid composition may also be heated or unheated. In one embodiment, the temperature of the third fluid composition is from about 10° C. to about 90° C., from about 20° C. to about 80° C. or from about 20° C. to about 40° C.

The third fluid composition may comprise adjunct ingredients selected from the group comprising, additional softener actives, silicone, organosilicones, structurants, deposition aids, perfumes, encapsulated perfumes, dispersing agents, stabilizers, pH control agents, colorants, brighteners, dyes, odor control agent, pro-perfumes, cyclodextrin, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants, electrolytes and mixtures thereof.

Suitable silicones for use in the present invention comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones for use in the present invention may be linear, branched or cross-linked. In one aspect, the organosilicones may comprise of silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin. As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

Silicone materials and silicone resins in particular, can conveniently be identified according to a shorthand nomenclature system known to those of ordinary skill in the art as "MDTQ" nomenclature. Under this system, the silicone is described according to presence of various siloxane monomer units which make up the silicone. Briefly, the symbol M denotes the monofunctional unit $(CH_3)_3SiO_{0.5}$; D denotes the difunctional unit $(CH_3)_2SiO$; T denotes the trifunctional unit $(CH_3)SiO_{1.5}$; and Q denotes the quadra- or tetra-functional unit $SiO_2$. Primes of the unit symbols (e.g. M', D', T', and Q') denote substituents other than methyl, and must be specifically defined for each occurrence.

Other modified silicones or silicone copolymers are also useful herein. Examples of these include silicone-based quaternary ammonium compounds (Kennan quats) disclosed in U.S. Pat. Nos. 6,607,717 and 6,482,969; end-terminal quaternary siloxanes; silicone aminopolyalkyleneoxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Patent Application Nos. 2007/0286837A1 and 2005/0048549A1.

In alternative embodiments of the present invention, the above-noted silicone-based quaternary ammonium compounds may be combined with the silicone polymers described in U.S. Pat. Nos. 7,041,767 and 7,217,777 and US Application number 2007/0041929A1.

In one aspect, the organosilicone may comprise a non-functionalized siloxane polymer that may have Formula (XXIV) below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \qquad \text{Formula (XXIV)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from 0 to about 10, or from 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the names DC 200 Fluid, DC 1664, DC 349, DC 346G available from Dow Corning® Corporation, Midland, Mich., and those available under the trade names SF1202, SF1204, SF96, and Viscasil® available from Momentive Silicones, Waterford, N.Y.

In one aspect, the organo silicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning® Corporation, and various Silwet® surfactants available from Momentive Silicones.

In another aspect, the functionalized siloxane polymer may comprise an aminosilicone. Suitable aminosilicones are described in U.S. Pat. No. 7,335,630 B2, U.S. Pat. No. 4,911,852, and USPA 2005/0170994A1. In one aspect the aminosilicone may be that described in U.S. PA 61/221,632. In another aspect, the aminosilicone may comprise the structure of Formula (XXV):

$$[R_1R_2R_3SiO_{1/2}]_n[(R_4Si(X—Z)O_{2/2}]_k[R_4R_4SiO_{2/2}]_m[R_4SiO_{3/2}]_j \quad \text{Formula (XXV)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

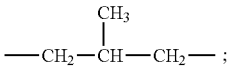

iii. Each Z may be independently selected from —$N(R_5)_2$; —

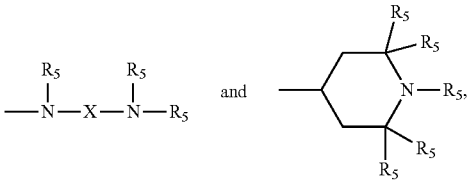

wherein each $R_5$ may be selected independently selected from H, $C_1$-$C_{20}$ alkyl; and $A^-$ may be a compatible anion. In one aspect, $A^-$ may be a halide;

iv. k may be an integer from about 3 to about 20, from about 5 to about 18 more or even from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from 0 to about 10, or from 0 to about 4, or 0;

In one aspect, $R_1$ may comprise —OH. In this aspect, the organosilicone is amidomethicone. Exemplary commercially available aminosilicones include DC 8822, 2-8177, and DC-949, available from Dow Corning® Corporation, and KF-873, available from Shin-Etsu Silicones, Akron, Ohio.

In one aspect the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of —$(CH_2)$s- wherein s is an integer from about 2 to about 8, from about 2 to about 4;

in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

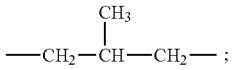

each Z is selected independently from the group consisting of

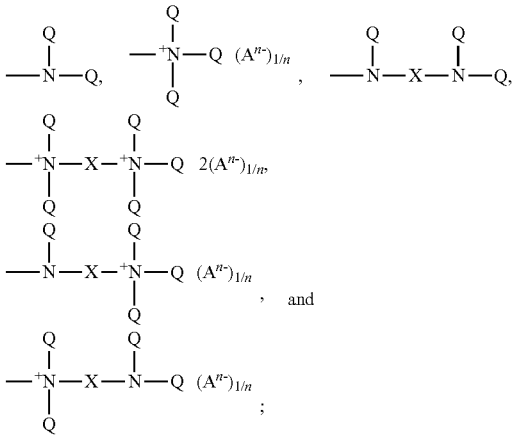

with the proviso that when Z is a quat, Q cannot be an amide, imine, or urea moiety;

for $ZA^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

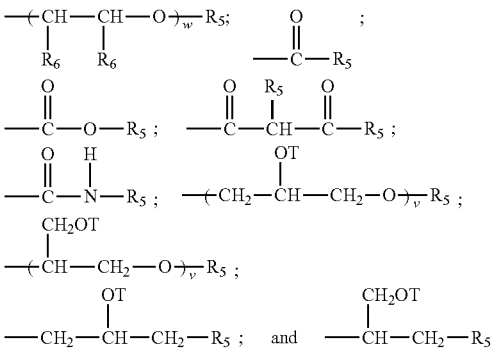

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

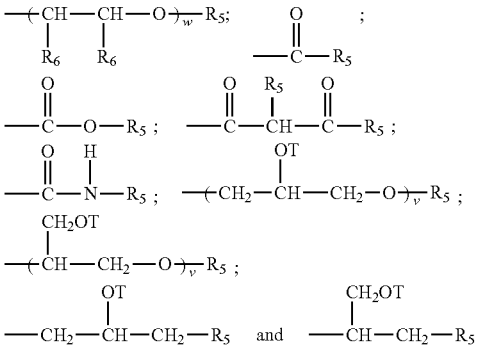

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —($CHR_6$—$CHR_6$—O—)$_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

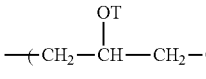

-continued

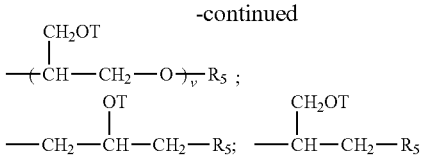

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In one aspect, the organosilicone may comprise amine ABn silicones and quat ABn silicones. Such organosilicones are generally produced by reacting a diamine with an epoxide. These are described, for example, in U.S. Pat. No. 6,903,061 B2, U.S. Pat. Nos. 5,981,681, 5,807,956, 6,903,061 and 7,273,837. These are commercially available under the trade names Magnasoft® Prime, Magnasoft® JSS, Silsoft® A-858 (all from Momentive Silicones).

In another aspect, the functionalized siloxane polymer may comprise silicone-urethanes, such as those described in U.S. PA 61/170,150. These are commercially available from Wacker Silicones under the trade name SLM-21200®.

When a sample of organosilicone is analyzed, it is recognized by the skilled artisan that such sample may have, on average, the non-integer indices for Formula (XXIV) and (XXV) above, but that such average indices values will be within the ranges of the indices for Formula (XXIV) and (XXV) above.

Suitable additional softener actives for use in the present invention include nonionic softeners. Non-limiting examples include ether and polyglycol containing compounds, paraffins, oils, fats and mixtures thereof.

Suitable additional softener actives for use in the present invention include anionic softeners. Non-limiting examples include anionic surfactants, fatty acids and mixtures thereof.

Suitable additional softener actives for use in the present invention include solid powders with a melting point above 200° C. Non-limiting examples include clays belonging to the classes of smectite, illite, kaolinite, chlorite and mixtures thereof.

Suitable electrolytes for use in the present invention include alkali metal and alkaline earth metal salts such as those derived from potassium, sodium, calcium, magnesium, ammonia and mixtures thereof.

The pH of the third fluid composition should be adjusted such that the pH of the final resultant fluid fabric enhancing composition has a pH from about 2 to about 5, from about 2.5 to about 4, or from about 2.5 to about 3.2. This pH range increases the stability of the fabric enhancing active.

Process of Producing a Liquid Fabric Enhancer Composition

The present invention is to a process of producing a liquid fabric enhancing composition comprising a fabric enhancing active, said process comprising the steps of;

Taking an apparatus A comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear, turbulence and/or cavitation in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear, turbulence and/or cavitation in the liquid, the at least one outlet 9 being located at the downstream end of the secondary mixing chamber 8; the orifice component 5 comprising at least two orifice units, 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighbouring orifice plates are distinct from each other;

- connecting one or more suitable liquid pumping devices to the first inlet 1A and to the second inlet 1B;
- pumping a liquid fabric enhancing active composition into the first inlet 1A, and, pumping a second liquid composition into the second inlet 1B, wherein the operating pressure of the apparatus is from about 0.1 bar to about 50 bar, from about 1 bar to about 20 or from about 1 bar to about 10 bar the operating pressure being the pressure of the liquid as measured in the pre-mix chamber 2;
- allowing the liquid fabric enhancing active and the second liquid composition to pass through the apparatus A at a desired flow rate, wherein as they pass through the apparatus A, they are dispersed one into the other, herein, defined as a liquid fabric enhancer intermediate.
- passing said liquid fabric enhancer intermediate from Apparatus A's outlet, to Apparatus B's inlet to subject the liquid fabric enhancer intermediate to additional shear and/or turbulence for a period of time within Apparatus B.
- circulating said liquid fabric enhancer intermediate within apparatus B with a circulation Loop pump at a Circulation Loop Flow Rate equal to or greater than said inlet liquid fabric enhancer intermediate flow rate in said Circulation Loop System. A tank, with or without a recirculation loop, or a long conduit may also be employed to deliver the desired shear and/or turbulence for the desired time.
- adding by means of a pump, piping and in-line fluid injector, an adjunct fluid, in one aspect, but not limited to an dilute salt solution, into Apparatus B to mix with the liquid fabric enhancer intermediate
- allowing the liquid fabric enhancer composition with the desired microstructure to exit Apparatus B at a rate equal to the inlet flow rate into Apparatus B.
- passing said liquid fabric enhancer composition exiting Apparatus B outlet through a heat exchanger to be cooled to ambient temperature, if necessary.
- discharging the resultant liquid fabric enhancing composition produced out of the outlet of the process.

The process comprises introducing, in the form of separate streams, the fabric enhancing active in a liquid form and a second liquid composition comprising other components of a fabric enhancing composition into the pre-mixing chamber 2 of Apparatus A so that the liquids pass through the orifice component 5. The fabric enhancer active in a liquid form and the second liquid composition pass through the orifice component 5 under pressure. The fabric enhancer active in liquid form and the second liquid composition can be at the same or different operating pressures. The orifice component 5 is configured, either alone, or in combination with some other component, to mix the liquid fabric enhancer active and the second liquid composition and/or produce shear, turbulence and/or cavitation in each liquid, or the mixture of the liquids.

The liquids can be supplied to the apparatus A and B in any suitable manner including, but not limited to through the use of pumps and motors powering the same. The pumps can supply the liquids to the apparatus A under the desired operating pressure. In one embodiment, an '8 frame block-style manifold' is used with a 781 type Plunger pump available from CAT pumps (1681 94th Lane NE, Minneapolis, Minn. 55449).

The operating pressure of conventional shear, turbulence and/or cavitation apparatuses is typically between about 6.9 bar and 690 bar. The operating pressure is the pressure of the liquid in the pre-mix chamber 2. The operating pressure is provided by the pumps.

The operating pressure of Apparatus A is measured using a Cerphant T PTP35 pressure switch with a RVS membrane, manufactured by Endress Hauser (Endress+Hauser Instruments, International AG, Kaegenstrasse 2, CH-4153, Reinach). The switch is connected to the pre-mix chamber 2 using a conventional thread connection (male thread in the pre-mix chamber housing, female thread on the Cerphant T PTP35 pressure switch).

The operating pressure of Apparatus A may be lower than conventional shear, turbulence and/or cavitation processes, yet the same degree of liquid mixing is achievable as seen with processes using conventional apparatuses. Also, at the same operating pressures, the process of the present invention results in better mixing than is seen with conventional shear, turbulence and/or cavitation processes. In one embodiment, the apparatus A has an operating pressure from about 0.1 bar to about 50 bar. In another embodiment, the operating pressure of the apparatus A is from about 0.25 bar to about 20 bar. In yet another embodiment, the operating pressure of the apparatus A is from about 0.5 bar to about 10 bar. It should be noted that the apparatus A can also, if desired, be operated at the higher pressures (up to 690 bar) seen in conventional processes.

As the fabric enhancing active and the second liquid composition flow through the Apparatus A, they pass through the orifices 13 and 21 of the orifice component 5. As they do, they exit the orifice 13 and/or 21 in the form of a jet. This jet produces shear, turbulence and/or cavitation in the fabric enhancing active and the second liquid composition, thus dispersing them one in the other to form a uniform mixture.

In conventional shear, turbulence and/or cavitation processes, the fact that the liquids are forced through the orifice 13 and/or 21 under high pressure causes them to mix. This same degree of mixing is achievable at lower pressures when the liquids are forced through a series of orifices, rather than one at a high pressure. Also, at equivalent pressures, the process of the present invention results in better liquid mixing than shear, turbulence and/or cavitation processes, due to the fact that the liquids are now forced through a series of orifices.

A given volume of liquid can have any suitable residence time and/or residence time distribution within the apparatus A. Some suitable residence times include, but are not limited to from about 1 microsecond to about 1 second, or more. The liquid(s) can flow at any suitable flow rate through the apparatus A. Suitable flow rates range from about 1 to about 1,500 L/minute, or more, or any narrower range of flow rates falling within such range including, but not limited to from about 5 to about 1,000 L/min.

For Apparatus B Circulating Loop System example, one may find it convenient to characterize the circulation flow by a Circulation Loop Flow Rate Ratio equal to the Circulation Flow Rate divided by the Inlet Flow Rate. Said Circulation Loop Flow Rate Ratio for producing the desired fabric enhancer composition microstructure can be from about 1 to about 100, from about 1 to about 50, and even from about 1 to about 20. The fluid flow in the circulation loop imparts shear and turbulence to the liquid fabric enhancer to transform the liquid fabric enhancer intermediate into a desired dispersion microstructure.

The duration of time said liquid fabric enhancer intermediate spends in said Apparatus B may be quantified by a Residence Time equal to the total volume of said Circulation Loop System divided by said fabric enhancer intermediate inlet flow rate. Said Circulation Loop Residence Time for producing desirable liquid fabric enhancer composition microstructures may be from about 0.1 seconds to about 10 minutes, from about 1 second to about 1 minute, or from about 2 seconds to about 30 seconds. It is desirable to minimize the residence time distribution.

Shear and/or turbulence imparted to said liquid fabric enhancer intermediate may be quantified by estimating the total kinetic energy per unit fluid volume. The kinetic energy per unit volume imparted in the Circulation Loop System to the fabric enhancer intermediate in Apparatus B may be from about 10 to 1,000,000 g/cm $s^2$, from about 50 to 500,000 g/cm $s^2$, or from about 100 to about 100,000 g/cm $s^2$. The liquid(s) flowing through Apparatus B can flow at any suitable flow rate. Suitable flow rates range from about 1 to about 1,500 L/minute, or more, or any narrower range of flow rates falling within such range including, but not limited to from about 5 to about 1,000 L/min. Apparatus A is ideally operated at the same time as Apparatus B to create a continuous process. The liquid fabric enhancer intermediate created in Apparatus A may also be stored in a suitable vessel and processed through apparatus B at a later time.

The process may be used to make many different kinds of fabric enhancing composition products including, but not limited to liquids, emulsions, dispersions, gels and blends.

In one embodiment, the resultant fabric enhancing composition is liquid at room temperature. In another embodiment, the resultant fabric enhancing composition is highly concentrated. By highly concentrated we herein mean the fabric enhancing active is present between 50% and 90% by weight of the fabric enhancing composition. In yet another embodiment, the resultant fabric enhancing composition is highly concentrated and is liquid at ambient temperature. The term liquid can encompass non-viscous liquids, viscous liquids, emulsions, dispersions, a gels or blends. The resultant fabric enhancing composition can encompass structured liquids, where the structuring is provided by the particles residing in the dispersion. These particles can be of any shape and size.

Those skilled the art will recognize what concentrations of components to add to achieve the resultant desired composition.

Another aspect of the present invention is a liquid fabric enhancing composition made using the process of the present invention. The liquid fabric enhancing composition can be used in a conventional automatic laundry machine, or can be used as a hand washing fabric enhancing composition.

Fabric Enhancer Activity Determination by $CatSO_3$ Titration

The fabric enhancer activity is determined by $CatSO_3$ titration as defined in Reid et al, "Tenside", Vol. 4 (1967), pp. 292-304. The method is based on the dye complexing properties of cationic and anionic surfactants. Determination of cationic matter is carried out by a two-phase (aqueous/organic) titration procedure. A known excess of sodium lauryl sulfate is added along with organic solvent and a mixed indicator to an aqueous aliquot of cationic sample. The sodium lauryl sulfate (anionic) and quaternary (cationic) compound complex, while the cationic indicating dye then forms, with an equivalent portion of the excess anionic surfactant, a pink complex which is soluble in the organic phase. When this two-phase system is titrated with a standardized cationic surfactant (hyamine 1622) there is first a reaction with the surplus anionic surfactant in the aqueous phase. When all the (non-complexed) anionic surfactant has reacted, the hyamine starts to react with the anionic surfactant previously complexed with the dye. The freed dyestuff is water-soluble. At the end-point the pink color of the organic phase is discharged; the organic layer becomes grey and with one further drop of the hyamine the organic layer turns to blue If appropriate, the sample is then made basic and the titration with Hyamine is continued. At this basic pH, all protonated amines are converted to free amines, which then release the corresponding sodium lauryl sulfate. This sodium lauryl sulfate is then titrated with Hyamine to the endpoint as before.

Calculation:

$$\%\ \text{Cationic as SO3 Equivalent} = \frac{[(B \times N2)(T1 \times N1)] \times 0.080 \times 100}{W}$$

Where:

T1=mL Cationic Reagent (Hyamine)

N1=Normality of Cationic Reagent

B=mL NaLS Standard Solution

N2=Normality of NaLS Standard Soln.

0.080=Milliequivalent Wt of SO3

W=Sample wt. x mls of aliquot/Dilution volume (weight of sample in aliquot)

Viscosity

A Brookfield model LV-II viscometer is used to measure viscosity. The formulations were measured using a #2 spindle at 60 rpm at 23° C. Based on spindle size and rpm, there is a +/−5 cps error.

Particle Index

The fabric enhancer active particulate surface area per mass is determined by a particle index measurement.

$$\text{Particle Index} = \frac{\text{(total particles from 50 nm to 1000 nm)}}{\text{mass of fabric enhancer active (picogram)}}$$

Data is obtained on particle size via the use of a laser light scattering method based on the Brownian motion of particles in a fluid suspension. The instrument for measuring total particles is a Nanosights NS500 using software Nanosight NTA 2.2, Nanoparticle Tracking and Analysis, release version build 0366. By tracking the movement of particles for a given amount of time and calculating the mean squared displacement for each particle tracked, particle size as well as number of particles can be calculated. From simultaneous measurement of the mean squared displacement of each particle tracked, the particle diffusion coefficient ($D_t$) and the hydrodynamic radius ($r_h$) can be determined using the Stokes-Einstein equation:

$$D_t = \frac{K_B T}{6\pi\eta r_h}$$

Where $K_B$ is Boltzmann's constant, T is temperature and η is solvent viscosity. Calculation of the concentration of the particles is based on the assumed scattering volume calculated from the dimensions of the field of view and depth of the laser beam. By counting the number of particles tracked at any instant the average concentration per scattering volume can be calculated. The average number of particles per milliliter of sample is then extrapolated from the assumed scattering volume. This number is then normalized against the amine based fabric enhancer active weight in the sample. Further analysis of the sample may be needed if the fabric enhancer active content is unknown. Examples to one skilled in the art for obtaining activity of amine based fabric enhancer active includes one or a combination of methods including fluid chromatography, mass spectroscopy, and nuclear magnetic resonance spectroscopy. The choice of low particle size cutoff of 50 nm is due to nearing the limitation of the Nanosights NS500 instrument for low refractive index particles such as many amine based fabric enhancer actives. The upper range particle size cutoff of 1000 nm is nearing the limitation on the technique to accurately track particles using Brownian motion. Particle Index sample preparation: Sample dilution is required to ideal working concentration for use with the Nanosights NS500. This is done using serial dilutions until the particle count within the experiment is between $10^7$/ml and $10^9$/ml. The fluid used for dilution is distilled and deionized water. Other instrument settings include camera gain: 680, camera shutter: 1330, record time: 90 seconds, detection threshold: 30, blur: 7×7, minimum track length: 10, minimum expected size: 50 nm. Analysis is repeated and the average calculated. The Nanosights NS500 instrument uses a laser to measure number of particles. The type of laser can impact the particle index calculation. For example, as measured on a new laser particle index values can range higher than when using an older laser. In examples 1-6 an older laser was used to measure particle index. For examples 7-8 a new laser with an output 75 mW at 532 nm was used to generate the particle index values. The average particle index difference was measured to be 50% lower when comparing old laser values with new laser values. For purposes of the present invention, particle index is measured using a Nanosights NS500 having a laser output of 75 mW at 532 nm.

Determination of Energy Input to Apparatus B

Option 1 (KE/V):

$$\frac{KineticEnergy}{\text{Volume}} = 0.5 * \rho * (Linearvelocity)^2$$

Where, $\rho$ = material density $$LinearVelocity = \frac{FlowRate}{\text{Cross-sectional Area}}$$

Where, $$Cross\text{-}sectionalArea = \pi\left(\frac{PipeDiameter^2}{4}\right)$$

$$ResidenceTime = \frac{\text{Volume}}{VolumetricFlowRate}$$

Where, $$\text{Volume} = (\text{Cross-sectional Area}) \cdot (PipeLength)$$

$$TotalKineticEnergy = \left(\frac{KineticEnergy}{Volume}\right) * (ResidenceTime)$$

Residence Time Calculation $$ResidenceTime = \frac{\text{Volume}}{VolumetricFlowRate}$$

$$\text{Volume} = (\text{Cross-sectional Area}) \cdot (PipeLength)$$

EXAMPLES

The following examples demonstrate how the process of the present invention can be used to make a fabric enhancing composition that has an increased particle index.

All examples using apparatus A were produced at 10 kg/min total making flow rate in a continuous fluid making process. Heated fabric enhancer active and heated deionized water containing adjunct materials were fed using positive displacement pumps (Wakesha Chemy Burrell, Delavan, Wis., USA), through Apparatus A (3 orifices), through apparatus B (a circulation loop fitted with a centrifugal pump (Alpha Laval, Richmond Va., USA) in which a 2.5% calcium chloride solution was pumped (Pulsa ECO Gearchem, Rochester, N.Y., USA and injected into the loop. The fluid fabric enhancer composition was immediately cooled to 22° C. with a plate heat exchanger (Alpha Laval, Richmond Va., USA). Fabric enhancer active, deionized water containing adjunct materials, and a 2.5% calcium chloride solution were continuously fed to the continuous fluid making process using pumps in which motor speed was controlled continuously from flow meter feedback (Emerson MicroMotion or Rosemount, Boulder, Colo., USA). Flow rates, pressures and temperatures of each inlet stream were monitored during processing to insure quality.

For comparative examples, Apparatus A was replaced with an IKA mill (inline rotor-stator mill model DR3-6, IKA Works, Wilmington, N.C., USA) fitted with 3 rotor-stator dispersing elements.

Example 1

| | Process | |
|---|---|---|
| | IKA Mill + Apparatus B | Apparatus A + Apparatus B |
| Formulation (% active unless otherwise noted) | A | B |
| Fabric Enhancing Active[a] | 14.4 | 14.7 |
| Fabric Enhancing Active[a] Temperature | 80° C. | 80° C. |
| Formic acid (ppm) | 250 | 250 |
| Antifoam[b] (ppm) | 150 | 150 |
| Hydrochloric Acid (ppm) | 225 | 225 |
| DTPA[c] (ppm) | 79 | 79 |
| Preservative[d] (ppm) | 75 | 75 |
| Salt[e] (ppm) | 650 | 1000 |
| Deionized Water | Balance | Balance |
| Deionized Water Temperature | 60° C. | 60° C. |
| Apparatus A Pressure Drop (bars) | N/A | 2.78 |
| Apparatus B Conditions Kinetic Energy/Volume (g/cm × $s^2$) | 8439 | 18987 |
| Particle Index[f] | 274 | 433 |
| Viscosity[g] (cPs) | 25 | 21 |

[a]An ester quaternary ammonium compound mixture with 9 parts ethanol and 3 parts coco oil. Activity is determined by $CatSO_3$ titration method as previously defined

[b]Silicone antifoam agent available from Dow Corning Corp. under the trade name DC2310

[c]Diethylenetriaminepentaacetic acid

[d]Proxel ® available from Arch Chemicals

[e]Salt as Calcium Chloride as a 2.5% solution in water

[f]Particle Index was determined using the Nanosights NS500 technique as previously defined.

[g]Viscosity of the fabric enhancer formulation was measured using the Brookfield model LV-II viscometer as previously defined.

As can be seen from Example 1, formulation B using the apparatus A and apparatus B of the present invention produced a product with a higher particle index with lower viscosity than formulation A using the IKA mill process. A higher particle index is indicative of good fluid-fluid dispersion, as this shows that the fluids were more efficiently mixed to produce more fabric enhancer particle surface area per mass.

Example 2

| | Process | |
|---|---|---|
| | IKA Mill + Apparatus B | Apparatus A + Apparatus B |
| Formulation (% active unless otherwise noted) | C | D |
| Fabric Enhancing Active[a] | 16.5% | 16.6% |
| Fabric Enhancing Active[a] Temperature | 80° C. | 80° C. |
| Formic acid (ppm) | 250 | 250 |
| Antifoam[b] (ppm) | 150 | 150 |
| Hydrochloric Acid (ppm) | 225 | 225 |
| DTPA[c] (ppm) | 79 | 79 |
| Preservative[d] (ppm) | 75 | 75 |
| Salt[e] (ppm) | 900 | 1250 |
| Deionized Water | Balance | Balance |
| Deionized Water Temperature | 60° C. | 60° C. |
| Apparatus A Pressure Drop (bars) | N/A | 2.49 |
| Apparatus B Conditions | 33755 | 33755 |
| Kinetic Energy/Volume (g/cm × $s^2$) | | |
| Particle Index[f] | 233 | 450 |
| Viscosity[g] (cPs) | 30 | 22 |

[a]An ester quaternary ammonium compound mixture with 9 parts ethanol and 3 parts coco oil. Activity is determined by $CatSO_3$ titration method as previously defined
[b]Silicone antifoam agent available from Dow Corning Corp. under the trade name DC2310
[c]Diethylenetriaminepentaacetic acid
[d]Proxel ® available from Arch Chemicals
[e]Salt as Calcium Chloride as a 2.5% solution in water
[f]Particle Index was determined using the Nanosights NS500 technique as previously defined.
[g]Viscosity of the fabric enhancer formulation was measured using the Brookfield model LV-II viscometer as previously defined.

As can be seen from Example 2, formulation D using the apparatus A and apparatus B of the present invention produced a product with a higher particle index and lower viscosity than formulation C using the IKA mill process. A higher particle index is indicative of good fluid-fluid dispersion, as this shows that the fluids were more efficiently mixed to produce more fabric enhancer particle surface area per mass.

Example 3

| | Process | |
|---|---|---|
| | Apparatus A | Apparatus A + Apparatus B |
| Formulation | E | F |
| Fabric Enhancing Active[a] | 17.7% | 16.5% |
| Fabric Enhancing Active[a] Temperature | 80° C. | 80° C. |
| Formic acid (ppm) | 250 | 250 |
| Antifoam[b] (ppm) | 150 | 150 |
| Hydrochloric Acid (ppm) | 225 | 225 |
| DTPA[c] (ppm) | 79 | 79 |
| Preservative[d] (ppm) | 75 | 75 |
| Salt[e] (ppm) | 0 | 1500 |
| Deionized Water | Balance | Balance |
| Deionized Water Temperature | 60° C. | 60° C. |
| Apparatus A Pressure Drop (bars) | N/A | 2.88 |
| Apparatus B Conditions | 0 | 33755 |
| Kinetic Energy/Volume (g/cm × $s^2$) | | |
| Particle Index[f] | 256 | 490 |
| Viscosity[g] (cPs) | >50,000 | 17 |

[a]An ester quaternary ammonium compound mixture with 9 parts ethanol and 3 parts coco oil. Activity is determined by $CatSO_3$ titration method as previously defined.
[b]Silicone antifoam agent available from Dow Corning Corp. under the trade name DC2310
[c]Diethylenetriaminepentaacetic acid
[d]Proxel ® available from Arch Chemicals
[e]Salt as Calcium Chloride as a 2.5% solution in water
[f]Particle Index was determined using the Nanosights NS500 technique as previously defined.
[g]Viscosity of the fabric enhancer formulation was measured using the Brookfield model LV-II viscometer as previously defined.

As can be seen from Example 3, formulation F using the apparatus A and apparatus B of the present invention produced a product with a higher particle index and greatly lower viscosity than formulation E which used apparatus A only. A higher particle index with low viscosity is indicative of good fluid-fluid dispersion, as this shows that the fluids were more efficiently mixed to produce more fabric enhancer particle surface area per mass.

Example 4

| | Process | | | |
|---|---|---|---|---|
| | IKA Mill | IKAMill | Apparatus A + Apparatus B | Apparatus A + Apparatus B |
| Formulation | G | H | I | J |
| Fabric Enhancing Active[a] | 14.4% | 13.75% | 15.2% | 14.9% |
| Formic acid (ppm) | 250 | 237 | 250 | 237 |
| Antifoam[b] (ppm) | 150 | 145 | 150 | 145 |
| Hydrochloric Acid (ppm) | 225 | 214 | 225 | 214 |
| DTPA[c] (ppm) | 79 | 75 | 79 | 75 |
| Preservative[d] (ppm) | 75 | 71 | 75 | 71 |
| Salt[e] (ppm) | 650 | 620 | 600 | 589 |
| Dye | — | 0.03 | — | 0.012 |
| Perfume | — | 1.53 | — | 1.35 |
| Phase stabilizing polymer[f] | — | 0.15 | — | 0.15 |
| Surfactant[g] | — | 0.25 | — | 0.25 |
| Silicone[h] | — | 0.5 | — | NA |
| Deionized Water | Balance | Balance | Balance | Balance |
| Particle Index[i] | 274 | 279 | 414 | 401 |

[a]An ester quaternary ammonium compound mixture with 9 parts ethanol and 3 parts coco oil. Activity is determined by $CatSO_3$ titration method as previously defined.
[b]Silicone antifoam agent available from Dow Corning Corp. under the trade name DC2310
[c]Diethylenetriaminepentaacetic acid
[d]Proxel ® available from Arch Chemicals
[e]Salt as Calcium Chloride as a 2.5% solution in water
[f]Rheovis ® CDE from the BASF Corp.
[g]Variquat ® 1215 from Evonik Industries
[h]Polydimethylsiloxane available from Dow Corning Corp. under the trade name DC349
[i]Particle Index was determined using the Nanosights NS500 technique as previously defined.

As can be seen from Example 4, particle index can be compared across formulations using varying types of adjunct ingredients. Formulations G and H use the same IKA mill process but differ in the type of adjunct ingredients added. In both formulations the particle index is similar. Formulations I and J use the same apparatus A+B process but differ in the type of adjunct ingredients added. In both formulations the particle index is similar.

Example 5

| | Process | | |
|---|---|---|---|
| | Apparatus A + Apparatus B | Apparatus A + Apparatus B | Apparatus A + Apparatus B |
| Formulation | K | L | M |
| Fabric Enhancing Active[a] | 11.3% | 14.7% | 16.4% |
| Fabric Enhancing Active[a] Temperature | 80° C. | 80° C. | 80° C. |
| Formic acid (ppm) | 250 | 250 | 250 |
| Antifoam[b] (ppm) | 150 | 150 | 150 |
| Hydrochloric Acid (ppm) | 225 | 225 | 225 |
| DTPA[c] (ppm) | 79 | 79 | 79 |
| Preservative[d] (ppm) | 75 | 75 | 75 |
| Salt[e] (ppm) | 800 | 1000 | 750 |
| Deionized Water | Balance | Balance | Balance |
| Deionized Water Temperature | 60° C. | 60° C. | 60° C. |
| Apparatus A Pressure Drop (bars) | 2.55 | 2.78 | 2.49 |
| Apparatus B Conditions Kinetic Energy/Volume (g/cm × $s^2$) | 2110 | 18987 | 33755 |
| Particle Index[f] | 420 | 432 | 433 |
| Viscosity[g] (cPs) | 11 | 21 | 35 |

[a]An ester quaternary ammonium compound mixture with 9 parts ethanol and 3 parts coco oil. Activity is determined by $CatSO_3$ titration method as previously defined.

[b]Silicone antifoam agent available from Dow Corning Corp. under the trade name DC2310

[c]Diethylenetriaminepentaacetic acid

[d]Proxel ® available from Arch Chemicals

[e]Salt as Calcium Chloride as a 2.5% solution in water

[f]Particle Index was determined using the Nanosights NS500 technique as previously defined.

[g]Viscosity of the fabric enhancer formulation was measured using the Brookfield model LV-II viscometer as previously defined.

As can be seen from Example 5, particle index can be used to compare samples which differ in fabric enhancer active concentrations. Particle indices are similar to each other going from 11.3% fabric enhancer active up to a 16.4% active fabric enhancer active when using similar process conditions.

Example 6

| | Process | |
|---|---|---|
| | Competitive Product* | Apparatus A + Apparatus B 10.9% |
| Formulation | N | O |
| Fabric Enhancing Active | 16.7%[a] | 11.03%[b] |
| Formic acid (ppm) | N/A | 250 |
| Antifoam[c] (ppm) | N/A | 150 |
| Hydrochloric Acid (ppm) | N/A | 225 |
| DTPA[d] (ppm) | N/A | 79 |
| Preservative[e] (ppm) | N/A | 75 |
| Salt[f] (ppm) | N/A | 200 |
| Dye | N/A | 0 |
| Perfume | N/A | 0 |
| Phase stabilizing polymer[g] | N/A | 0 |
| Surfactant[h] | N/A | 0 |
| Silicone[i] | N/A | 0 |
| Deionized Water | Balance | Balance |

-continued

| | Process | |
|---|---|---|
| | Competitive Product* | Apparatus A + Apparatus B 10.9% |
| Particle Index[j] | 292 | 477 |
| Viscosity[k] (cPs) | 82 | 32 |

[a]An quaternary ammonium compound. Activity is determined by $CatSO_3$ titration method as previously defined.

[b]An ester quaternary ammonium compound mixture with 9 parts ethanol and 3 parts coco oil. Activity is determined by $CatSO_3$ titration method as previously defined.

[c]Silicone antifoam agent available from Dow Corning Corp. under the trade name DC2310

[d]Diethylenetriaminepentaacetic acid

[e]Proxel ® available from Arch Chemicals

[f]Salt as Calcium Chloride as a 2.5% solution in water

[g]Rheovis ® CDE from the BASF Corp.

[h]Variquat ® 1215 from Evonik Industries

[i]Polydimethylsiloxane available from Dow Corning Corp. under the trade name DC349

[j]Particle Index was determined using the Nanosights NS500 technique as previously defined.

[k]Viscosity of the fabric enhancer formulation was measured using the Brookfield model LV-II viscometer as previously defined.

*Snuggle ® Blue

As can be seen from Example 6, particle index is higher for the sample made using the apparatus A and apparatus B process of the present invention over a commercial competitive product.

Example 7

The following example used a similar procedure to the previous examples except that a new laser replaced the old laser in the Nanosights NS500 instrument. The specifications for the new laser used in the Nanosights NS500 is output-75 mW at 532 nm.

| | Process | |
|---|---|---|
| | IKA mill + Apparatus B | Apparatus A + Apparatus B |
| Formulation | P | Q |
| Fabric Enhancing Active[a] | 14.7% | 14.7% |
| Fabric Enhancing Active[a] Temperature | 80° C. | 80° C. |
| Formic acid (ppm) | 250 | 250 |
| Antifoam[b] (ppm) | 150 | 150 |
| Hydrochloric Acid (ppm) | 225 | 225 |
| DTPA[c] (ppm) | 79 | 79 |
| Preservative[d] (ppm) | 75 | 75 |
| Salt[e] (ppm) | 650 | 400 |
| Deionized Water | Balance | Balance |
| Deionized Water Temperature | 60° C. | 80° C. |
| Apparatus A Pressure Drop (bars) | N/A | 6 |
| Apparatus B Conditions | 18987 | 33755 |
| Apparatus B Conditions Kinetic Energy/Volume (g/cm × $s^2$) | | |
| Particle Index[f] | 674 | 1212 |

As can be seen from Example 7, formulation Q using apparatus A and B of the present invention produced a product with higher particle index than formulation P.

Example 8

The following example used a similar procedure to the previous examples except that a new laser replaced the old laser in the Nanosights NS500 instrument. The specifications for the new laser used in the Nanosights NS500 is output-75 mW at 532 nm.

| | Process | |
|---|---|---|
| | Apparatus A + Apparatus B | Apparatus A + Apparatus B |
| Formulation | R | S |
| Fabric Enhancing Active[a] | 14.7% | 14.7% |
| Fabric Enhancing Active[a] Temperature | 80° C. | 80° C. |
| Formic acid (ppm) | 250 | 250 |
| Antifoam[b] (ppm) | 150 | 150 |
| Hydrochloric Acid (ppm) | 225 | 225 |
| DTPA[c] (ppm) | 79 | 79 |
| Preservative[d] (ppm) | 75 | 75 |
| Salt[e] (ppm) | 400 | 400 |
| Deionized Water | Balance | Balance |
| Deionized Water Temperature | 60° C. | 80° C. |
| Apparatus A Pressure Drop (bars) | 1.2 | 6 |
| Apparatus B Conditions | 2110 | 33755 |
| Apparatus B Conditions Kinetic Energy/Volume (g/cm × $s^2$) | | |
| Particle Index[f] | 868 | 1212 |
| Viscosity[g] (cPs) | 168 | 40 |

As can be seen from Example 8, formulation S using apparatus A and B of the present invention run at higher pressures in apparatus A and higher kinetic energy conditions in apparatus B produced a product with higher particle index and lower viscosity than formulation R. A higher particle index with low viscosity is indicative of good fluid-fluid dispersion, as this shows that the fluids were more efficiently mixed to produce more fabric enhancer particle surface area per mass.

Example 9

The fluid fabric enhancer active formulations in Examples 1-6 are used to soften fabrics. The formulations are used in a laundry rinse of an automatic laundry washing machine. Upon completion of the rinse, the fabrics are either machine dried or line dried.

Example 10

Each of the fluid fabric enhancer active formulations of Examples 1-6 are also placed in a unit dose packaging comprising a film that surrounds each formulations. Such unit does are used by adding the unit dose to the wash liquor and/or the rinse. Upon completion of the rinse, the fabrics are either machine dried or line dried.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a fluid composition comprising:

combining a plurality of fluids in an apparatus, said apparatus comprising: one or more inlets (1A) and one or more inlets (1B), said one or more inlets (1A) and said one or more inlets (1B) being in fluid communication with one or more suitable liquid transporting devices; a pre-mixing chamber (2), the pre-mixing chamber (2) having an upstream end (3) and a downstream end (4), the upstream end (3) of the pre-mixing chamber (2) being in liquid communication with said one or more inlets (1A) and said one or more inlets (1B); an orifice component (5), the orifice component (5) having an upstream end (6) and a downstream end (7), the upstream end of the orifice component (6) being in liquid communication with the downstream end (4) of the pre-mixing chamber (2), wherein the orifice component (5) is configured to spray liquid in a jet and produce shear, turbulence and/or cavitation in the liquid; a secondary mixing chamber (8), the secondary mixing chamber (8) being in liquid communication with the downstream end (7) of the orifice component (5); at least one outlet (9) in liquid communication with the secondary mixing chamber (8) for discharge of liquid following the production of shear, turbulence and/or cavitation in the liquid, the at least one outlet (9) being located at the downstream end of the secondary mixing chamber (8); the orifice component (5) comprising at least two orifice units, (10) and (11) arranged in series to one another and each orifice unit comprises an orifice plate (12) comprising at least one orifice (13), an orifice chamber (14) located upstream from the orifice plate (12) and in liquid communication with the orifice plate (12); and wherein neighboring orifice plates are distinct from each other;

wherein said combining is achieved by applying a force from about 0.1 bar to about 50 bar to said plurality of fluids, said force being applied by said transportation devices transporting said plurality of fluids to a second apparatus, and via said second apparatus, applying a shearing energy of from about 10 g/cm $s^2$ to about 1,000,000 g/cm $s^2$ for a residence time from about 0.1 seconds to about 10 minutes to said combined plurality of fluids;

optionally, heating individual and/or combined fluids from inlets 1A and/or 1B before, during or after shearing step, to temperatures from about 15° C. to about 95° C.;

optionally cooling said combined plurality of fluids, during and/or after said shearing step, to temperatures from about 5° C. to about 45° C.;

optionally, adding a electrolyte;

optionally, adding in one or more adjunct ingredients to said plurality of fluids and/or combined plurality of fluids; and optionally, recycling said combined plurality of fluids through one or more portions of said process.

2. The process of claim 1 wherein the orifice plates are aligned axially, with the center of each plate offset from the centerline by no more than 25% of the pipe diameter.

3. The process of claim 1 wherein the process comprises adding in one or more adjunct ingredients useful for fabric conditioning.

* * * * *